United States Patent [19]

Dettke et al.

[11] 4,352,690

[45] Oct. 5, 1982

[54] ACID GOLD BATH FOR THE ELECTROLESS DEPOSITION OF GOLD

[75] Inventors: Manfred Dettke; Ludwig Stein, both of Berlin, Fed. Rep. of Germany

[73] Assignee: Schering Aktiengesellschaft, Berlin and Bergkamen, Fed. Rep. of Germany

[21] Appl. No.: 284,450

[22] Filed: Jul. 17, 1980

[30] Foreign Application Priority Data

Aug. 4, 1980 [DE] Fed. Rep. of Germany ..... 3029785

[51] Int. Cl.[3] ..... C23C 3/02

[52] U.S. Cl. ..... 106/1.23; 106/1.26; 427/437; 427/443.1

[58] Field of Search ..... 106/1.23, 1.26

[56] References Cited

U.S. PATENT DOCUMENTS

| | | | |
|---|---|---|---|
| 3,032,436 | 5/1962 | Gostin et al. | 106/1.23 |
| 3,300,328 | 1/1967 | Luce | 106/1.23 |
| 4,091,128 | 5/1978 | Franz et al. | 427/304 |
| 4,154,877 | 5/1979 | Jratny | 427/328 |
| 4,307,136 | 12/1981 | Prost-Tournier et al. | 106/1.23 |

*Primary Examiner*—Lorenzo B. Hayes

*Attorney, Agent, or Firm*—Michael J. Striker

[57] ABSTRACT

Stabilized aqueous, acid gold bath, containing a dicyanogold(I)-complex, a complex former, a reducing agent and customary additives, for electroless deposition of gold onto gold and metals that are more electronegative than gold, as well as alloys of these metals, containing a salt of hydroxylamine or a hydroxylamine derivative as reducing agent and a fluoride or hydrogen fluoride as stabilizer. Preferred embodiments include the use of an alkali- or ammonium dicyanoaurate(I) as dicyanogold(I)-complex; using a salt of hydroxylamine or a hydroxylamine derivative of the general formula

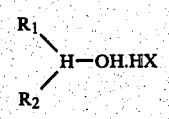

in which $R_1$ and $R_2$ are the same or different and represent hydrogen or alkyl of 1 to 5 carbon atoms and X represents the residue of an inorganic acid, as reducing agent; using an alkali fluoride or an alkali hydrogen fluoride as stabilizer; and a pH-value less than 3, preferably from 0.5 to 2.8.

7 Claims, No Drawings

ACID GOLD BATH FOR THE ELECTROLESS DEPOSITION OF GOLD

BACKGROUND OF THE INVENTION

The invention concerns a stabilized aqueous, acid gold bath containing a dicyanogold(I)-complex, a complex former, a reducing agent and customary additives, for the electroless deposition of gold onto gold and metals which are more electronegative than gold, as well as alloys of these metals.

Gold baths for the electroless deposition of gold are already known. They involve an alkaline or acid gold bath, containing predominantly an alkalidicyanoaurate(I), a complex former, a reducing agent, as well as additives for increasing the velocity of deposition and for improvement of the adhesiveness (U.S. Pat. Nos. 4,091,128, 3,300,328, 4,154,877, 3,032,436, German Offenlegungsschrifts DE-OS 2,052,787, DE-OS 2,518,559). All of these baths have, as a rule, an unsatisfactory stability, decomposing during deposition of metallic gold.

These baths have the further disadvantage that at a pH-value less than 3 a decomposition of the dicyanoaurate(I)-complex into difficult to dissolve gold(I)-cyanide and hydrocyanic acid occurs.

The mentioned gold baths are, moreover, suited only for the gilding of metals that are more electronegative than gold. An optimal electroless deposition of gold onto gold is, on the other hand, not possible by means of these baths.

SUMMARY OF THE INVENTION

The present invention has the object of providing a stabilized aqueous, acid gold bath which makes possible the electroless deposition of gold onto gold and metals more electronegative than gold, as well as their alloys.

This object will be accomplished according to the present invention with a gold bath of the above described type, thereby characterized in that it contains a salt of hydroxylamine or a hydroxylamine derivative as reducing agent, and a fluoride or hydrogen fluoride as stabilizer.

Particular embodiments include:

that the bath contain an alkali- or ammonium-dicyanoaurate(I) as dicyanogold(I)-complex;

that the bath contain a salt of hydroxylamine or a hydroxylamine derivative of the general formula

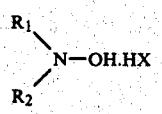

in which $R_1$ and $R_2$ are the same or different and represent hydrogen or alkyl of 1 to 5 carbon atoms and X represents the residue of an inorganic acid, preferably of hydrochloric or muriatic or sulfuric acid, as reducing agent;

that the bath contains extra alkali chloride and/or bromide as well as, if necessary, unsaturated carbonic acids; and that the bath display a pH-value less than 3, preferably from about 0.5 to 2.8.

A particular advantage of the bath according to the present invention is that gold can be deposited without current from a stable bath onto gold surfaces. In this manner, already present gold coatings, which are too thin, can be optionally strengthened with the aid of the bath according to the present invention. The bath makes possible also the gilding of alloys, that are customary in the semiconductor industry, for example, iron-nickel- and iron-nickel-cobalt-alloys.

The bath according to the present invention has the further advantage that the cementation of gold onto metals that are more electronegative than gold, such as for example copper and nickel, will be promoted, and indeed through stabilization of the dicyanogold(I)-complex to pH-values less than 3, even at the boiling temperature of the bath.

As dicyanogold(I)-complex, all alkali-dicyanoaurate(I), for example, the sodium- and potassium-complex salts and ammoniumdicyanourate(I), are suitable.

Expediently, the concentration can amount to between about 0.05 and 30 g gold/liter.

According to the present invention, a salt of hydroxylamine or a hydroxylamine derivative of the general formula

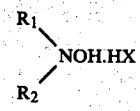

is used as reducing agent, in which $R_1$ and $R_2$ are the same or different and represent hydrogen or alkyl of 1 to 5 carbon atoms, and X represents the residue of an inorganic acid, preferably of hydrochloric or muriatic or sulfuric acid, and in which, as alkyl, may be mentioned for example methyl, ethyl, propyl, n-butyl and n-pentyl. The stability of this salt is so extraordinarily great in the acid medium of the bath according to the present invention, that a decomposition into ammonia and dinitrogen monoxide hardly occurs.

As stabilizer, the bath according to the present invention contains a fluoride or a hydrogen fluoride, preferably an alkali fluoride or an alkali hydrogen fluoride, for example, a sodium or potassium salt of these compounds.

To increase the velocity of deposition, it has been shown to be advantageous to add to the bath alkali chloride and/or bromide, such as, for example, sodium chloride, potassium chloride or sodium bromide, as well as, if necessary, unsaturated carbonic acid. Suitable carbonic acids of this type are, for example, propionic acid, aryl acid and crotonic acid. Moreover, polyhydroxy carbonic acids, dicarbonic acids and other complex formers, such as for example succinic acid, citric acid, nitrilotriacetic acid or ethylene diamine tetraacetic acid, can expediently be added, since these work to accelerate the metal deposition.

In order to adjust the pH-value to less than 3, preferably from 0.5 up to 2.8, dilute sulfuric acid will be used, which is added to the bath in required amounts. It is to be understood, however, that the bath according to the present invention is also stable at higher pH-values, and displays advantageous effectiveness.

The basic composition of the bath according to the present invention is as follows:

| | |
|---|---|
| gold (as metal) | 0.05–30 gram/liter |
| reducing agent | 0.5–25 gram/liter |
| fluoride | 1.0–30 gram/liter |

-continued

| | |
|---|---|
| additives | 1.0–150 gram/liter. |

It is of particular advantage to select a mol ratio of gold to fluoride which is greater than 1:1.

The operational temperature of the bath can be selected from about room temperature up to about boiling temperature, preferably from about 60° to 85° C.

The use of the bath according to the present invention follows in known manner, in that the appropriately pre-treated—depending upon the substrate—object is dipped in practical manner into the bath solution.

It is advantageous herewith either to stir the bath solution or to agitate the article, in order to obtain smooth, uniform surfaces.

The bath according to the present invention can be used, in particular, for the chemical gilding of metallic surfaces, such as gold, and metals more electronegative than gold, for example, copper, silver gold or nickel, and alloys of these metals. After suitable pre-treatment, non-metallic materials, such as, for example, made from plastic, glass or ceramic, may also be gilded.

It is of particular technical advantage that the bath according to the present invention works with a constant deposition velocity up to about 3.0 μm/h.

A further advantage of the bath according to the present invention is that the deposition velocity remains the same even after a standing period of several months.

The bath according to the present invention makes it possible to produce foils of optional thickness. The porosity of the deposit is so slight with coating thicknesses of about 0.2 μm, that the substrate will not be attacked by 1:1 diluted nitric acid.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

The following examples of bath compositions are given by way of example to enable one to deposit very uniform, well adhering and ductile coatings, under the given operational conditions.

EXAMPLE 1

| | |
|---|---|
| Potassium dicyanoaurate-I | 0.02 mol/liter |
| Citric acid | 0.10 mol/liter |
| Potassium hydrogen difluoride | 0.12 mol/liter |
| Potassium chloride | 2.00 mol/liter |
| Hydroxylammoniumchloride | 0.06 mol/liter |
| pH-value: 2.8 | |
| Temperature: 70° C. | |
| Deposition velocity: 0.8 μm/h. | |

EXAMPLE 2

| | |
|---|---|
| Ammonium dicyanoaurate-I | 0.015 mol/liter |
| Succinic acid | 0.250 mol/liter |
| Potassium fluoride | 0.120 mol/liter |
| Acrylic acid | 0.125 mol/liter |
| Di-sodium salt of ethylene dinitrilotetraacetic acid | 0.010 mol/liter |
| Ammonium chloride | 1.200 mol/liter |

-continued

| | |
|---|---|
| Hydroxylammoniumsulfate | 0.025 mol/liter |
| pH-value: 2.3 | |
| Temperature: 85° C. | |
| Deposition velocity: 1.2 μm/h. | |

EXAMPLE 3

| | |
|---|---|
| Potassium dicyanoaurate-I | 0.03 mol/liter |
| Citric acid | 0.23 mol/liter |
| Potassium fluoride | 0.15 mol/liter |
| Potassium chloride | 1.50 mol/liter |
| Hydroxyldimethylammonium chloride | 0.05 mol/liter |
| pH-value: 2.8 | |
| Temperature: 85° C. | |
| Deposition velocity: 0.5 μm/h. | |

It will be understood that each of the elements described above, or two or more together, may also find a useful application in other types of metal baths differing from the types described above.

While the invention has been illustrated and described as embodied in an acid gold bath for the electroless deposition of gold, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a stabilized aqueous, acidic gold plating bath for the electroless deposition of gold on gold and metals that are more electronegative than gold and alloys thereof containing a dicyanogold(I)-complex, a complex former and a reducing agent; the improvement comprising a stabilizer selected form the group consisting of an alkali metal fluoride and an alkali metal hydrogen fluoride and, as reducing agent, a hydroxyl amine derivative having the formula

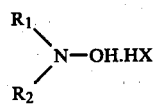

in which $R_1$ and $R_2$ are the same or different and represent hydrogen or alkyl of 1–5 carbon atoms and X represents the residue of an inorganic acid.

2. The gold bath according to claim 1, containing an alkali metal- or ammonium dicyanoaurate(I) as said dicyanogold(I)-complex.

3. The gold bath according to claim 1, wherein said inorganic acid is selected from the group consisting of hydrochloric and sulfuric acid.

4. The gold bath according to claim 1, further comprising an alkali metal chloride, an alkali metal bromide or mixtures thereof.

5. The gold bath according to claim 4, further comprising unsaturated carbonic acids.

6. The gold bath according to claim 1, wherein the pH-value is less than 3.

7. The gold bath according to claim 6, wherein said pH-value is between about 0.5 and 2.8.

* * * * *